US005299540A

United States Patent [19]

Fransson et al.

[11] Patent Number: 5,299,540

[45] Date of Patent: Apr. 5, 1994

[54] ARRANGEMENT FOR A FUEL LINE IN AN INTERNAL COMBUSTION ENGINE

[75] Inventors: Håkan Fransson, Björnlunda; Peter Sperle, Nykvarn, both of Sweden

[73] Assignee: Saab Scania Aktiebolag, Sweden

[21] Appl. No.: 975,551

[22] PCT Filed: Jul. 2, 1992

[86] PCT No.: PCT/SE92/00498

§ 371 Date: Feb. 22, 1993

§ 102(e) Date: Feb. 22, 1993

[87] PCT Pub. No.: WO93/01409

PCT Pub. Date: Jan. 21, 1993

[30] Foreign Application Priority Data

Jul. 2, 1991 [SE] Sweden ..... 9102059-4

[51] Int. Cl.[5] ..... F02M 55/02; F02F 1/24

[52] U.S. Cl. ..... 123/468; 123/193.5

[58] Field of Search ..... 123/456, 468, 469, 470, 123/DIG. 1, 193.3, 193.5

[56] References Cited

U.S. PATENT DOCUMENTS

| | | | |
|---|---|---|---|
| 3,125,078 | 3/1964 | Reiners | 123/468 |
| 3,832,983 | 9/1974 | Nickly | 123/193.5 |
| 3,845,748 | 11/1974 | Eisenberg | 123/469 |
| 3,949,724 | 4/1976 | Nickly | 123/193.5 |
| 4,214,560 | 7/1980 | Nickly | 123/193.5 |
| 4,485,790 | 12/1984 | Nishimura et al. | 123/470 |
| 5,062,405 | 11/1991 | Daly | 123/456 |

FOREIGN PATENT DOCUMENTS

| | | | |
|---|---|---|---|
| 826216 | 12/1951 | Fed. Rep. of Germany . | |
| 3802886 | 8/1988 | Fed. Rep. of Germany | 123/193.3 |

*Primary Examiner*—E. Rollins Cross
*Assistant Examiner*—Thomas Moulis
*Attorney, Agent, or Firm*—Ostrolenk, Faber, Gerb & Soffen

[57] ABSTRACT

A respective fuel injector is provided for each cylinder in a multiple cylinder internal combustion engine. Each fuel injector is located in a respective cylinder head. There are a plurality of fuel passages for each cylinder head. Each fuel passage into the cylinder head is in two sections. One section extends from the space for receiving the fuel injector diagonally with respect to the longitudinal direction of the engine and opens on the transverse surface of the cylinder head and is sealed there. Another passage section extends at an angle to the first passage section and then intersects the lateral side surface of the cylinder head. The two passage sections each comprise a bore in the cylinder head. A wall inside the cylinder head extends between and separates two spaces for receiving inlet valves to the injector and two spaces for receiving exhaust valves from the injector. That wall extends on one side along an air intake port into the cylinder head. On the other side of the wall is a cooling channel which separates the wall from the spaces for the exhaust valve. The wall extends diagonally to the longitudinal direction of the engine, and lines between each of the pairs of valves are essentially diagonal in the same direction as the wall.

22 Claims, 3 Drawing Sheets

ARRANGEMENT FOR A FUEL LINE IN AN INTERNAL COMBUSTION ENGINE

This invention relates to an arrangement for a fuel line for a fuel injector system of an internal combustion engine and particularly relates to an arrangement of ports and channels within the cylinder head of the engine for transmitting fuel.

PRIOR ART

In diesel engines for use in heavier trucks, for example, a method is known for using so-called fuel injectors which are designed integral with a high pressure pump arranged separately for each injector. In this case each injector is supplied with fuel from a low pressure pump and the high pressure required for the injection is generated in each injector. This obviates the need for long pipes with many connections subjected to high pressure, thereby reducing the risk of leakage. However, this type of injector requires more pipes than other known types of fuel injectors. At the same time the space for these pipes is even more limited due, among other things, to the fact that each injector also requires a drive to perform the pumping function. Normally this drive is provided by means of rocker arms arranged above the injectors and whose movements are controlled by a camshaft.

This gives rise to practical problems in finding space for the fuel lines, particularly the pipes nearest the injectors. One known method of solving this problem is to design the pipes in the form of bores in the cylinder head of the engine. An example of this is shown in patent specification U.S. Pat. No. 4,971,016, which describes how two injectors arranged in a common cylinder head are supplied with fuel via bored ports. The bores are connected one of the transverse sides of the cylinder head to a pump and valves incorporated in the rest of the fuel system. There are no connections requiring a great deal of space on the lateral surfaces of the cylinder head, on which intake and outlet manifolds for the engine must conventionally be connected.

However, this known solution presupposes that the cylinder head is designed so that sufficient space is created on the transverse side of the cylinder head, and also so that the engine only has one cylinder head. On the other hand, in the case of a multiple cylinder engine with separate cylinder heads for each cylinder, the known solution cannot be used. In cases where the engine is also of the type having several admission and exhaust valves and/or several intake and exhaust ports for each cylinder, there are practical problems in finding space and a suitable wall for designing the fuel lines in the form of bored ports.

OBJECT OF THE INVENTION

The object of this invention is to provide fuel ports in the cylinder head even in cases where the engine has several separate cylinder heads. Further objects are to be able to use a simple, cheap production method such as boring for designing such ports, and also to be able to use such ports in cases where the engine has several admission and exhaust valves and/or several intake and exhaust ports. Further objects are to simplify the fuel lines and also the connections required in the fuel line arrangement for fuel injectors, and also to provide, by simple means, pipes which require little space either inside or outside the cylinder head, so that connections can be reduced as can the risk of leakage.

BRIEF DESCRIPTION OF THE INVENTION

This is achieved according to the invention by designing the arrangement in accordance with the invention, there is a respective fuel injector for each cylinder in a multiple cylinder internal combustion engine. Each fuel injector is located in a respective cylinder head.

There are a plurality of fuel passages extending in the cylinder head. Each fuel passage is in two sections including a first section extending laterally out from the space which receives the fuel injector in a direction diagonally to the longitudinal direction of the engine and a second fuel passage section extending at an angle to the first section and then intersecting the lateral side of the cylinder head. All of the first passage sections extend to and open on the transverse surface of the respective cylinder head and are sealed there. All of the second passage sections open on a longitudinal lateral surface of the cylinder head. Each passage section comprises a bore in the cylinder head.

A wall inside the cylinder head extends between and separates one or more and preferably two spaces for receiving an inlet valve to the injector and one or more and preferably two spaces for receiving an exhaust valve from the injector. That wall extends so that on one side of it there is an air inlet port into the cylinder head. On the other side of the wall there is a cooling channel which separates the wall from the spaces for receiving an exhaust valve. The wall extends diagonally to the longitudinal direction of the engine. A respective line between each of the pairs of valves extends essentially diagonally in the same direction as the wall. The invention provides a favourable fuel line arrangement inside the cylinder head of the engine for interaction with external fuel lines, and enables the fuel to be supplied on the same side as the supply of admission air to the engine. The fuel ports arranged according to the invention enable the wall material available in the cylinder head to be used so that the intake port can be installed so that it provides favourable flow conditions, whilst the passages can be connected to external fuel lines through optimum use of available wall surface in the cylinder head.

DESCRIPTION OF THE DRAWINGS

An embodiment exemplifying the invention is described below with reference to the attached drawings, where.

DESCRIPTION OF AN EXEMPLIFYING EMBODIMENT

Figure 1:
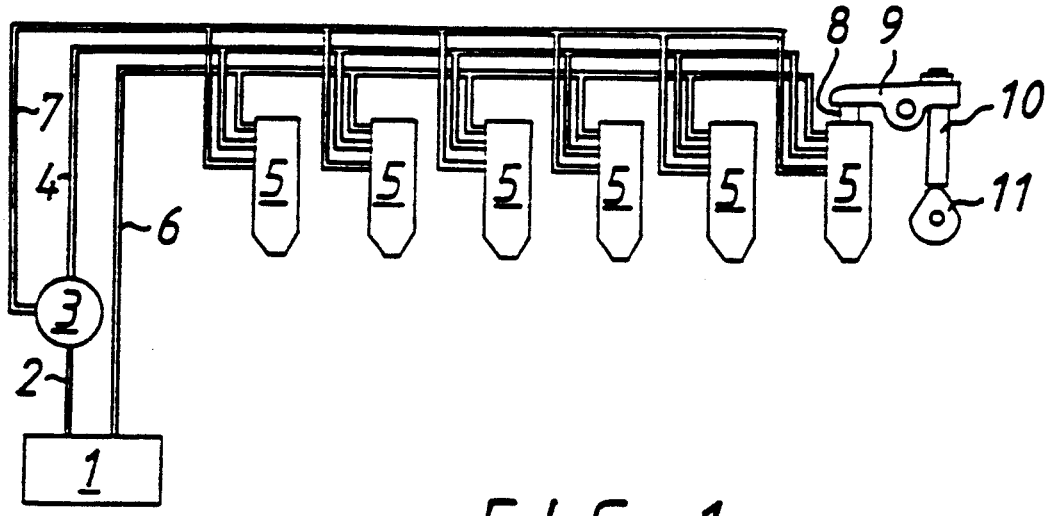
FIG. 1 is a diagrammatic representation of a fuel system for an engine.

A fuel system shown diagrammatically in FIG. 1 is designed for use in a multiple cylinder diesel engine 12, for example a six-cylinder in-line engine. It may be designed for a heavier vehicle such as a truck. Fuel from a fuel tank 1 is fed through a suction line 2 to a fuel pump 3, from which fuel is pumped out into a pressure line 4 and on to different fuel injectors 5. The number of fuel injectors 5 corresponds to the number of combustion chambers for engine 12, which is six in this embodiment. A return line 6, in which excess fuel from the respective injectors 5 can be returned to tank 1, is connected to each injector 5. A control pressure line 7, in which fuel of a certain pressure from pump 3 is supplied to the respective injectors 5, for controlling the injection in terms of time relative to the engine speed and/or dependent on other engine parameters, is also connected to each injector 5. The pressure in control pressure line 7 is controlled for this purpose under the influence of an electrical control system, not shown, connected to sensors sensing different engine parameters.

Fuel injectors 5 incorporate pumping elements which are mechanically actuated by a driving mechanism incorporating push rods 8, 10, rocker arms 9 and a camshaft 11 driven by the engine. In FIG. 1 this is shown diagrammatically only for one of fuel injectors 5, but all injectors 5 are driven similarly. In this case camshaft 11 is common to all injectors 5, whilst push rods 8, 10 and rocker arms 9 are individual for the respective injectors 5. The pumping elements ensure that the fuel fed to injectors 5 is given a high pressure suitable for the injection. The pressure generated by fuel pump 3 is relatively low and is largely sufficient to ensure that the fuel can safely be supplied to the respective injectors 5. Fuel injectors 5 of this type, with integral pumping elements, are often called injectors, thus this term is used in the remainder of the description. Because both such injectors 5 and the remaining aspects of the design of fuel systems for injectors are well known in themselves, the description does not include them.

Figure 2:
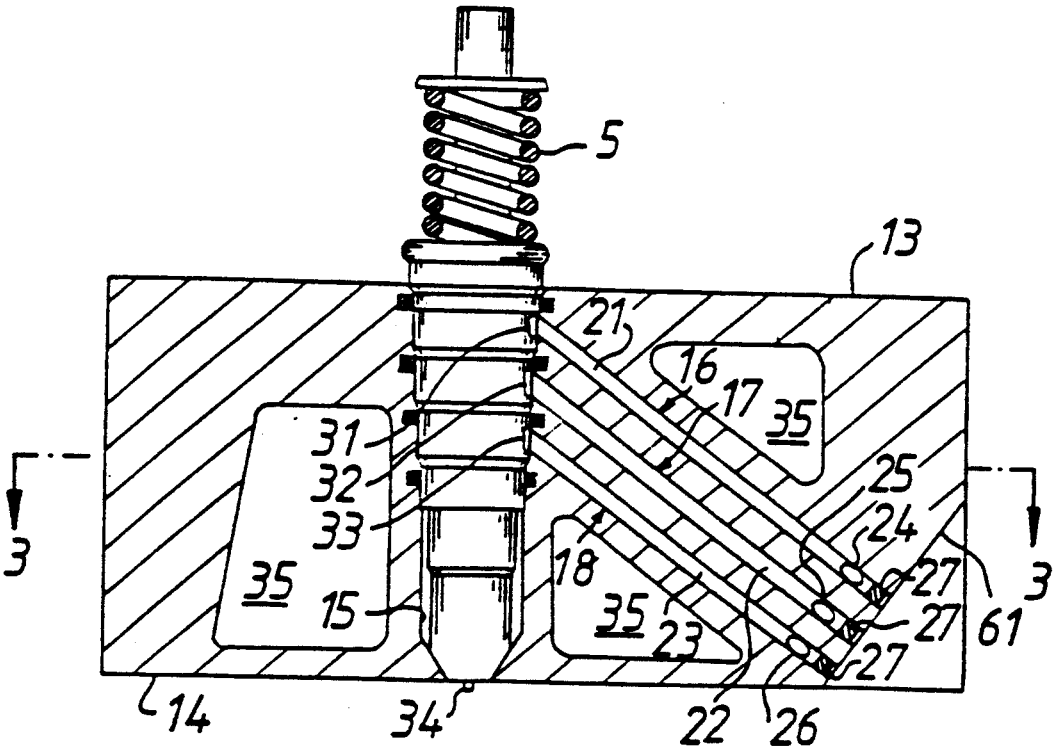
FIG. 2 shows a vertical cross-section through a cylinder head of the engine.
Figure 4:
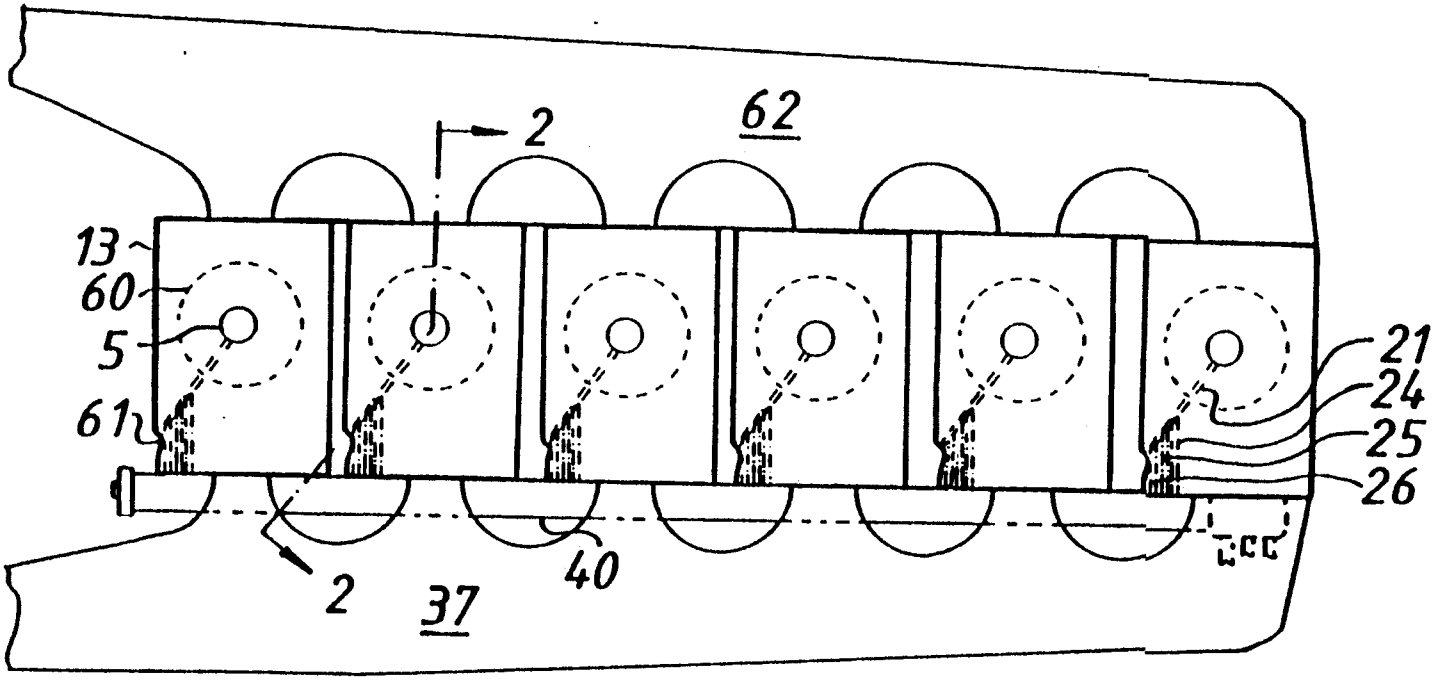
FIG. 4 shows a diagrammatic cross-sectional view of the engine viewed from above.

FIG. 2 shows a vertical cross-section 2—2, according to FIG. 4, of cylinder head 13 of the engine at an injector 5. The engine according to this embodiment is designed with separate cylinder heads 13 for each combustion chamber, and all the cylinder heads have an identical design, as have fuel lines 4–6 in the same. The remainder of the description is therefore confined to describing the design of one of cylinder heads 13.

Cylinder head 13 is designed with a lower side 14 secured by means of conventional bolted connections to an engine block in which are arranged cylinders which, together with pistons and the cylinder head, demarcate the combustion chamber of the engine. One of fuel injectors 5 is mountably secured in a vertical through hole 15 in cylinder head 13. The three fuel lines 4, 6, 7, shown diagrammatically in FIG. 1, are connected to injector 5. An upper passage 16 in cylinder head 13 is incorporated in control pressure line 7, a central passage 17 is incorporated in return line 6, and lower passage 18 is incorporated in pressure line 4. Passages 16–18 are designed as bores provided in cylinder head 13. To enable the bores to be provided in the limited wall surface of cylinder head 13 they are constructed as angular bores. The three bores 21, 22, 23, which are shown in a longitudinal section in the direction of the bores in FIG. 2, have been produced in a first boring operation. Three further bores 24, 25, 26 have been produced in a second boring operation at an angle relative to the first bores 21–23. FIG. 2 only shows the ends of these second bores 24–26 and how they are connected to the first bores 21–23. At their respective inlet holes, i.e. at their respective openings on a transverse surface, the first bores 21–23 are sealed by means of sealing plugs 27.

The first bores 21–23 extend between the transverse surface on the cylinde head, and hence also a surface running transverse to the engine, and the space containing injector 5.

The second bores 24–26 are produced from a longitudinal side of cylinder head 13 and have a limited depth sufficient to ensure that bores 24–26 extend into the first bores 21–23. The inlet holes for the second bores 24–26 all open out on one longitudinal side of engine 12. As will be seen from the description below it is important that all the inlets to bores 24–26 have their opening on the same side of engine 12.

Passages 16–18 in cylinder head 13, which are formed by these first and second cylinders 21–26, are used to supply fuel to and from injector 5. These passages 16–18 open out into cylinder head 13 in three separate spaces 31–33 sealed by O-rings and communicating directly with different parts of injector 5. A nozzle 34 on injector 5 opens out into the combustion chamber of the engine, injecting into it a suitable proportion of the fuel supplied to injector 5. In an intrinsically conventional manner cylinder head 13 also exhibits a number of coolant passages 35 communicating with the cooling system of the engine. A cam transmission for controlling the valves of the engine and for driving injector 5 is also arranged in cylinder head 13, but is not shown here. Alternatively the drive can be provided by means of an overhead camshaft transmission.

Figure 3:
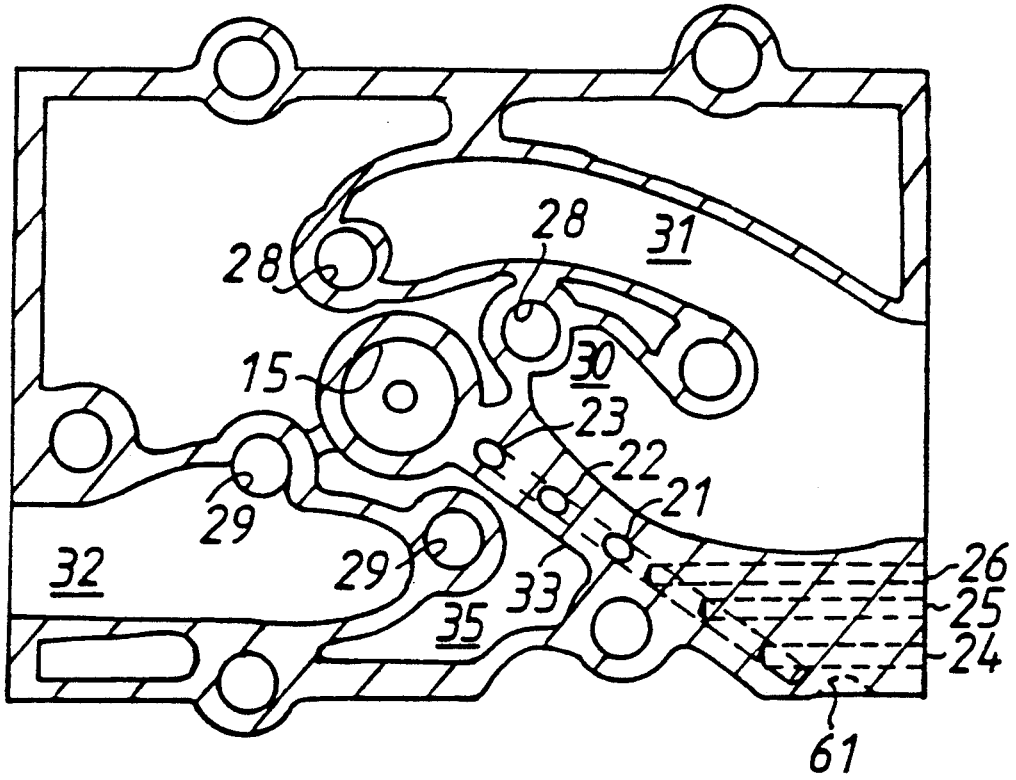
FIG. 3 shows a horizontal cross-section of the cylinder head.

FIG. 3 shows a horizontal cross-section 3—3 according to FIG. 2. FIG. 3 is diagrammatic and the parts essential to the invention largely correspond to FIG. 2, whilst less important parts are shown in a simplified embodiment, or are not shown, e.g. injector 5. Cylinder head 13 incorporates several, more specifically four, valves per cylinder. Two of the valves are inlet valves and two are exhaust valves. FIG. 3 only shows the respective storage holes of the valves, the holes for the inlet valves being denoted by 28, and the holes for the exhaust valves by 29.

Cylinder head 13 incorporates an intake port for supplying combustion air to the cylinder in question via the inlet valves, and an exhaust port for discharging exhaust gases via the two exhaust valves. The intake port runs from a common opening on one of the lateral sides of the cylinder head to two separate intake ports 30, 31 in the vicinity of the admission valves. All cylinder heads 13 of the engine are arranged in this embodiment in such a manner relative to each other that their respective intake ports 30, 31 open out on one side of the engine, and the exhaust ports 32 open out on the opposite side of the engine, as shown in FIG. 4.

Cylinder head 13, with intake and exhaust ports 30, 31 and 32, respectively, arranged on opposite sides in this way, are normally said to be of the cross-flow type, because the exchange of gases takes place in the transverse direction of the engine.

The valves in cylinder head 13 are arranged in an angularly distorted manner, which means that a line through the two inlet valves or the two exhaust valves forms an obtuse angle to the longitudinal direction of the engine. Between one of the intake ports 30 and a coolant passage 35 adjacent to exhaust port 32, and also between one of the inlet valves and one of the exhaust valves, cylinder head 13 is designed with a partition 33 extending in a diagonal direction between one of its corners and its hole 15 located centrally in relation to the cylinder. By arranging the valves so that they are angularly distorted it has been possible to design this partition 33 with a greater wall thickness than would otherwise be possible, taking into consideration the other parts of cylinder head 13 taking up space. This has enabled space to be created for bores 21–26 forming fuel passages 16–18. The three first bores 21–23 are arranged one above the other and in the same vertical plane, which is why only the top bore 21 is shown in FIGS. 3 and 4. To facilitate the boring operations the respective cylinder heads 13 are designed with a recess 61 on their surface running transverse in relation to the longitudinal direction of the engine, from which recess the boring of the first bores 21–23 is carried out. Recess 61 is designed so that a surface at right angles to the first bores 21–23 has been formed, thereby facilitating boring of the same. Viewed in a vertical plane, as shown in FIG. 2, the first bores 21–23 are designed with a continuous pitch from their respective inlet openings on the transfer surface to their respective outlet openings in hole 15. This means that these bores do not contain any pockets or the like in which air from fuel flowing through can accumulate and which could impair the function of injector 5. The other bores 24–26 are also designed advantageously with a similar pitch.

The advantage of designing wall 33 with a side which extends essentially in close contact with and along an intake port is that fuel passages 16–18 are cooled by the air flowing through intake port 30. Moreover, designing wall 33 so that it essentially avoids close contact with exhaust port 32 and is instead adjacent to a coolant passage 35 provided in the cylinder head further improves the temperature conditions in passages 16–18.

One advantage of allowing fuel passages 16–18 to have their openings on the intake side of the engine is that the fuel lines connected to the rest of the fuel system of the engine can also be arranged on a relatively cold side of the engine.

FIG. 4 shows diagrammatically a simplified view, from above, of the different parts of engine 12. The cylinders of the engine, in this case six, are denoted by the FIG. 60. Each cylinder head 13 incorporates an injector 5, shown diagrammatically. The three second bores 24–26, which form an angle with the first bores 21–23, all open out on the same side as intake manifold 37 of the engine.

The exhaust manifold 62 of the engine is located on the opposite side of the engine. Underneath intake manifold 37 fuel moulding 40 extends along all cylinder heads 13. Fuel moulding 40 is advantageously designed in accordance with the detailed description given in patent application SE 9102059-4. Moulding 40 lies in contact with the respective cylinder heads 13 along a surface which incorporates the openings from fuel passages 16–18, and is sealed by means of O-rings on the contact faces. The design of moulding 40 means that the fuel passages housed in it require little space.

The arrangement with fuel moulding 40 described also means that the sections of fuel lines 4, 6, 7 contained in the moulding are well protected against external damage, whilst for servicing it is easy to dismantle the same. Assembly is made similarly easy and the risk of incorrect connection is eliminated. Because moulding 40 is located on the intake side of engine 12 and not on the same side as its exhaust manifold, there is no risk either that the fuel will be heated, thus effective utilisation of the fuel is ensured.

The passages can be incorporated in the cylinder head by casting, but it is also advantageously achieved by boring, thereby enabling production to be carried out simply and very accurately. Bores 21–26 can be produced advantageously in a multi-unit drilling machine which enables the first and second bores 21–23 and 24–26, respectively, to be produced in one operation.

Because partition 33 has been designed with sufficient wall thickness both the first and second bores can be extended mutually parallel, whilst remaining a sufficient distance from each other. By designing the bores at an angle the intake and outlet ports of the engine can be designed advantageously from the point of the flow conditions in the engine. Sufficient space for the fuel ports in the cylinder head is very limited, particularly in the case of engines with double intake and/or exhaust ports, and it is an advantage in these cases to be able to design the intake and outlet ports without consideration being given to the fuel passages.

The invention is not limited to the embodiment described but can be modified within the scope of the patent claims attached. The invention can therefore be used in a different design, e.g. in terms of the inlet and exhaust valves of the cylinder head, intake and exhaust ports and/or number of fuel passages.

The description of the fuel passages designed as ports relates to an advantageous embodiment, and in alternative embodiments these bores can instead consist wholly or partly of port sections produced by casting, for example.

The surface into which the first port sections 21–23 open out extend according to the embodiment described between one of the transverse surfaces of the cylinder head and its bottom. It is also possible to design the recess forming the surface from one of the other surfaces of the cylinder head to form a corresponding surface for the openings of the port sections. The openings for the respective port sections need not be arranged in the same surface, as shown, but may instead be arranged in different surfaces.

We claim:

1. An arrangement for supplying fuel to fuel injectors in a multiple cylinder internal combustion engine, the engine having a cylinder block, the cylinder block having a plurality of cylinder heads arrayed therealong, the cylinder block having first and second opposite lateral sides at the opposite sides of the array of cylinder heads; each cylinder head having first and second lateral surfaces toward the respective one of the first and second lateral sides of the block, and having a transverse surface which is transverse to the longitudinal direction of the engine and to the lateral surfaces;

a respective fuel injector for each of the cylinders, the fuel injector for each cylinder being in the cylinder head for that cylinder; the cylinder head for each injector having a space therein for housing the respective injectors;

the fuel supply arrangement comprising:

a respective set of fuel passages in at least one cylinder head for serving each fuel injector, all of the fuel passages of the set extending from the first lateral surface of the cylinder head to the injector in the cylinder head;

at least one of the fuel passages in the cylinder head being comprised of a first and a second interconnecting passage section;

the first passage section opening on and extending between the transverse surface of the cylinder head and the space within the cylinder head for housing the injector; the first passage section being sealed at its opening on the transverse surface of the cylinder head;

the second passage section intersecting the first passage section at an angle, and the second passage section extending to the first lateral surface of the cylinder head.

2. The arrangement of claim 1, wherein at least the first passage sections have a continuous pitch from their openings on the transverse surface of the cylinder head to the space inside the cylinder head for housing the fuel injector.

3. The arrangement of claim 1, wherein the transverse surface of the at least one cylinder head includes a surface part at right angles to the longitudinal direction of the first passage sections of the cylinder head, and the first passage sections of the cylinder at the at least one cylinder head opening into the surface part of the transverse surface of the cylinder head.

4. The arrangement of claim 1, further comprising means at the at least one cylinder head for supplying fuel to each of the fuel passages at the entrance to the respective second passage section of the fuel passage at the lateral surface of the cylinder head.

5. The arrangement of claim 1, wherein the at least one cylinder head comprises a respective cylinder head for each cylinder.

6. The arrangement of claim 1, wherein each of the first passage section and the second passage section is a bore within the at least one cylinder head.

7. The arrangement of claim 6, wherein the at least one cylinder head comprises a respective cylinder head for each cylinder.

8. The arrangement of claim 1, wherein all of the fuel passages in each of the cylinder heads include the respective first and the second passage sections thereof.

9. The arrangement of claim 8, wherein each of the first passage sections and each of the second passage sections comprises a bore in the cylinder head; all of the first passage sections in each cylinder head being essentially parallel to each other, and all of the second passage sections in each cylinder head being essentially parallel to each other.

10. The arrangement of claim 8, with a respective one of the cylinder heads for each cylinder, and each cylinder head having the fuel passages thereof of substantially identical design.

11. The arrangement of claim 8, wherein for one of the cylinders, the cylinder head includes an inlet valve receiving space, an exhaust valve receiving space spaced away from the inlet valve receiving space, and a wall extending into the cylinder head and passing between the inlet valve receiving space and the exhaust valve receiving space.

12. The arrangement of claim 11, further comprising an intake port into the cylinder head for combustion air and placed for communicating with the inlet valve receiving space, the intake port and the wall being so placed that the wall in the cylinder head has one side that is along and communicates with the intake port.

13. The arrangement of claim 12, wherein the wall extends essentially at an angle direction with respect to the longitudinal direction of the engine between essentially a corner of the cylinder head toward one lateral side of the cylinder head and the space in the cylinder head for housing a fuel injector.

14. The arrangement of claim 12, further comprising at least one outlet port for exhaust gases at the other lateral side of the cylinder head from the intake port; the second passage sections having an entrance opening at the side of the cylinder head that is on the same side thereof as the intake port.

15. The arrangement of claim 1, wherein the cylinder head has an intake port for combustion air at one lateral side of the cylinder head and has at least one outlet port for exhaust gases at the other later side of the cylinder head;

the second passage sections having an entrance opening at the side of the cylinder head that is on the same side thereof as the intake port.

16. The arrangement of claim 15, wherein for one cylinder the cylinder head includes an inlet valve receiving space and an exhaust valve receiving space spaced away from the inlet valve receiving space, and a wall extending into the cylinder head and passing between the inlet valve receiving space and the exhaust valve receiving space;

an intake port into the cylinder head placed for communicating with the inlet valve receiving space, and the wall in the cylinder head having one side that is along and communicates with the intake port.

17. The arrangement of claim 16, further comprising a cooling channel in the cylinder head on the opposite side of the wall away from the one side thereof.

18. The arrangement of claim 17, wherein the space for receiving the exhaust valve is separated from the opposite side of the wall by the cooling channel.

19. The arrangement of claim 18, wherein the wall extends essentially at an angle direction with respect to the longitudinal direction of the engine between essentially a corner of the cylinder head toward one lateral side of the cylinder head and the space in the cylinder head for housing a fuel injector.

20. The arrangement of claim 19, wherein for the one cylinder there are two of the spaces for receiving intake valves, both placed in the cylinder head to be exposed to the intake port and positioned so at to be joined by a line generally diagonally directed in the direction of the wall in the cylinder head.

21. The arrangement of claim 20, wherein for the one cylinder there are two of the spaces for receiving exhaust valves, both placed in the cylinder head to be exposed to the exhaust port and positioned so as to be joined by a line generally diagonally directed in the direction of the wall in the cylinder head.

22. The arrangement of claim 19, wherein for the one cylinder there are two of the spaces for receiving exhaust valves, both placed in the cylinder head to be exposed to the exhaust port and positioned so as to be joined by a line generally diagonally directed in the direction of the wall in the cylinder head.

* * * * *